US008573512B2

(12) United States Patent
Hu

(10) Patent No.: US 8,573,512 B2
(45) Date of Patent: Nov. 5, 2013

(54) HANDHELD WATER DISCHARGING DEVICE

(75) Inventor: Xiaodi Hu, Shen Zen (CN)

(73) Assignee: Globe Union Industrial Corp., Taichung (TW)

( * ) Notice: Subject to any disclaimer, the term of this patent is extended or adjusted under 35 U.S.C. 154(b) by 301 days.

(21) Appl. No.: 12/838,562

(22) Filed: Jul. 19, 2010

(65) Prior Publication Data

US 2012/0012676 A1 Jan. 19, 2012

(51) Int. Cl.
*A62C 31/00* (2006.01)

(52) U.S. Cl.
USPC ..... 239/447; 239/443; 239/558; 239/583; 239/586

(58) Field of Classification Search
USPC ..... 239/443–449, 558, 583, 586
See application file for complete search history.

(56) References Cited

U.S. PATENT DOCUMENTS

| | | | | |
|---|---|---|---|---|
| 7,341,239 | B2 * | 3/2008 | Hodel et al. | 251/230 |
| 7,380,731 | B1 * | 6/2008 | Hsu | 239/447 |
| 7,766,260 | B2 * | 8/2010 | Lin | 239/449 |
| 7,909,269 | B2 * | 3/2011 | Erickson et al. | 239/449 |

* cited by examiner

*Primary Examiner* — Christopher Kim

(57) ABSTRACT

A handheld water discharging device contains a housing; a water supplying pipe fixed in the housing and including a valve holder and a discharge assembly; wherein the valve holder includes an inlet room, a distributing room, a peripheral flowing room, a central flowing room, and a groove; the distributing room includes a plurality of ratchet blocks; the discharge assembly is fixed at the groove and includes a first outflow member and a second outflow member; a valve core displaces in the distributing room and includes a first closing segment; a resilient element is used to push the valve core downward; a positioning member is fixed in the distributing room and includes a biasing portion, a number of engagement teeth, and a stem; a button element serves as to push the positioning member upward properly.

18 Claims, 18 Drawing Sheets

HANDHELD WATER DISCHARGING DEVICE

BACKGROUND OF THE INVENTION

1. Field of the Invention

The present invention relates to a handheld water discharging device.

2. Description of the Prior Art

A conventional handheld water discharging device used in kitchen includes a valve holder, and the valve holder includes a distributing room defined therein to receive a valve core actuated by a controlling structure to move between at least two positions, thus forming different functional water sprays.

However, such a controlling structure of the handheld water discharging device is switched by using two buttons, having inconvenient operation. Even though some controlling structures only includes a single button, but the handheld water discharging device can not be kept at a certain water spray level unless the single button is pressed constantly, having inconvenient operation as well.

Although some improved handheld water discharging devices are kept at a certain water spray level in normal state, when it is operated at a lower water pressure, the water spray is switched automatically without being kept at the certain level.

The present invention has arisen to mitigate and/or obviate the afore-described disadvantages.

SUMMARY OF THE INVENTION

The primary object of the present invention is to provide a handheld water discharging device which is capable of overcoming the shortcomings of the conventional digital shower system.

Further object of the present invention is to provide a handheld water discharging device that a level of the first functional water spray is kept without being pressed constantly and being affected by a low water pressure, thus operating the handheld water discharging device easily.

Another object of the present invention is to provide a handheld water discharging device that different functional water spray levels are switched quickly and easily.

To obtain the above objectives, a handheld water discharging device provided by the present invention comprises a housing;

a water supplying pipe fixed in the housing and including a valve holder and a discharge assembly; wherein the valve holder includes an inlet room to receive water, a distributing room communicating with the inlet room, a peripheral flowing room communicating with the distributing room through a first exit, a central flowing room communicating with the distributing room through a second exit, and a groove communicating with the peripheral flowing room and the central flowing room; the distributing room includes a plurality of ratchet blocks relative to the second exit;

the discharge assembly is fixed at the groove of the valve holder and includes a first outflow member to flow water from the peripheral flowing room so as to form a first functional water spray, and a second outflow member to flow water from the central flowing room so as to form a second functional water spray;

a valve core displaces in the distributing room, and includes a first closing segment to close the first exit so that the second exit is open and closes the second exit of the valve holder so that the first exit is open;

a resilient element is used to push the valve core downward;

a positioning member is fixed in the distributing room and is pushed upward and rotated properly so as to retain with ratchet blocks and to push the valve core so that the first closing segment keeps closing the first exit, and the positioning member rotates to disengage from the ratchet blocks when it is pushed upward again so that the resilient element pushes the positioning member downward to be positioned through the valve core, and the first closing segment of the valve core keeps closing the second exit;

the housing is formed in a tube shape and includes an inlet end, an outlet end, and a through hole disposed on a bottom end thereof; the distributing room includes an inlet fixed on a first inflow side thereof to communicate with the inlet room and includes the first exit formed above the inlet, the second exit arranged below the inlet, and the ratchet blocks mounted around an inner wall thereof, and each ratchet block includes a recess portion fixed on a top end thereof and two top planes on two sides of the recess portion individually, between each two abutting ratchet blocks is defined an axial slot; the first closing segment of the valve core closes the first exit of the valve holder when the valve core is pushed upward to move so that the second exit is open; and when the valve core is pushed downward to move, the second exit of the valve holder is closed by the first closing segment so that and the first exit is open; the valve core includes a second closing segment mounted below the first closing segment to displace vertically with the valve core so as to movably engage with an inner wall of the distributing room above the ratchet blocks; the resilient element is fitted between a top end of the valve core and a top end of the distributing room; the positioning member includes a number of engagement teeth arranged on an outer wall thereof, and each engagement tooth moves vertically along the axial slot and includes an inclined face formed on a bottom end thereof so that when the positioning member is pushed upward, the engagement teeth disengage from the axial slots to rotate toward a circumferential direction and to retained in the recess portions; and when the positioning member is pushed upward, the engagement teeth disengage from the recess portions to rotate toward the circumferential direction and locate above the axial slots, and when an upward pushing force disappears, the engagement teeth move into the axial slots so that the valve core is pushed downward to move; the button element is inserted through a bottom end of the distributing room and includes a loop, the loop includes a plurality of sliding tabs arranged around an outer wall to move along the axial slots and a number of first tilted planes disposed on a top end thereof; the loop includes an extension mounted on a bottom end thereof and extending downward out of the bottom end of the distributing room and pushed upward so that the first tilted planes engage with the inclined faces of the engagement teeth.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
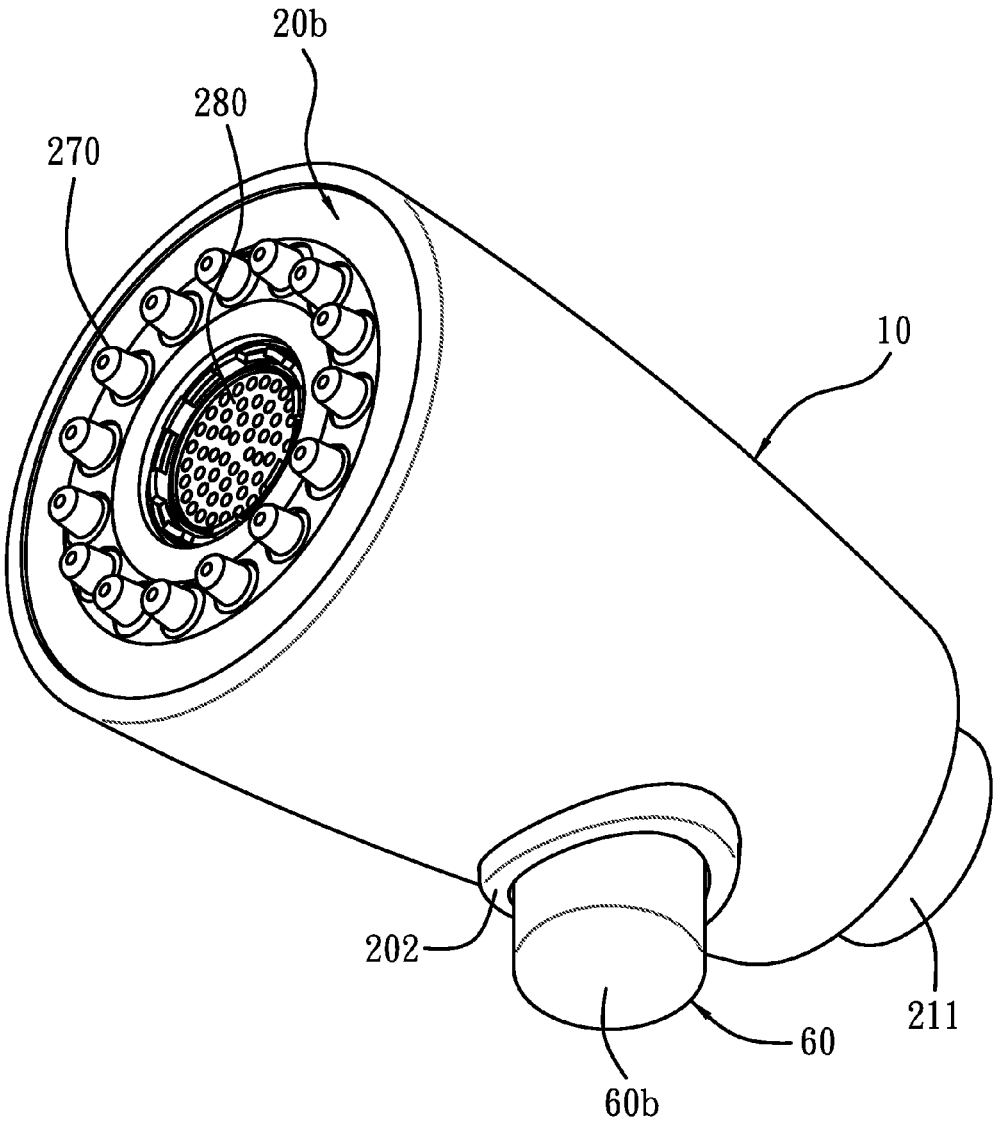
FIG. 1 is a perspective showing the assembly of a handheld water discharging device according to a preferred embodiment of the present invention.
Figure 2:
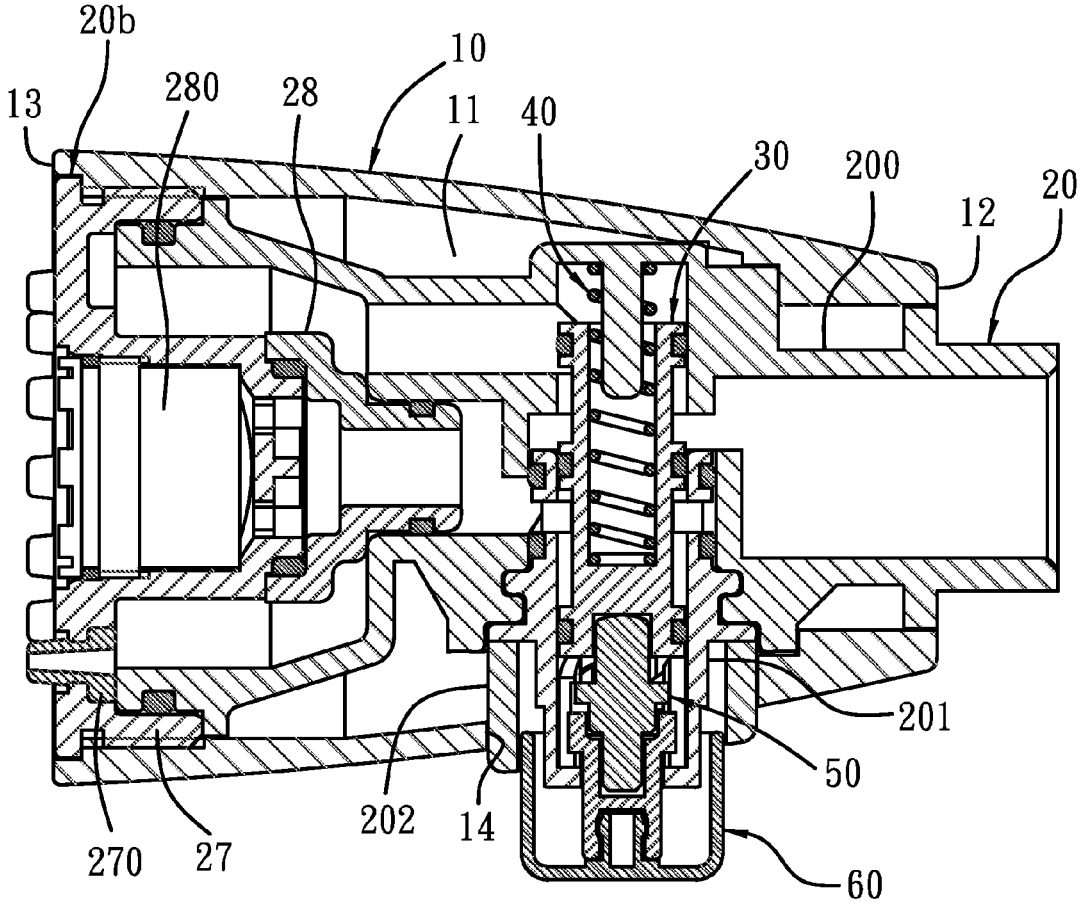
FIG. 2 is a cross sectional view showing the assembly of the handheld water discharging device according to the preferred embodiment of the present invention.
Figure 3:
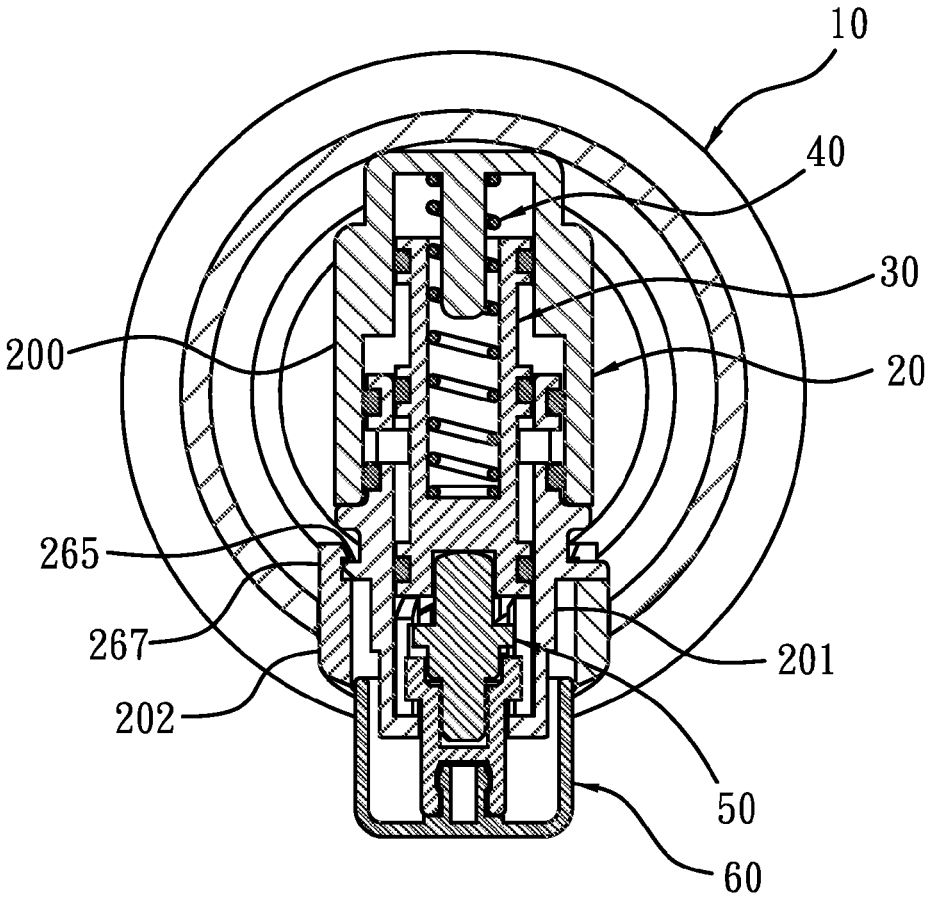
FIG. 3 is another cross sectional view showing the assembly of the handheld water discharging device according to the preferred embodiment of the present invention.
Figure 4:
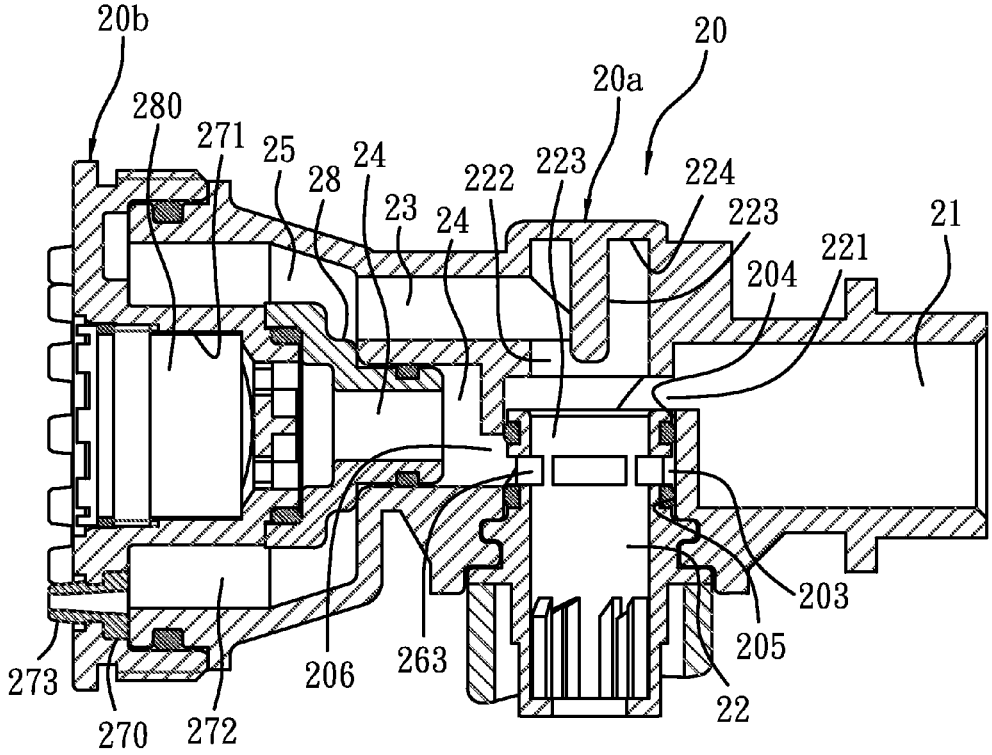
FIG. 4 is a cross sectional view showing the assembly of a water supplying pipe of the handheld water discharging device according to the preferred embodiment of the present invention.
Figure 5:
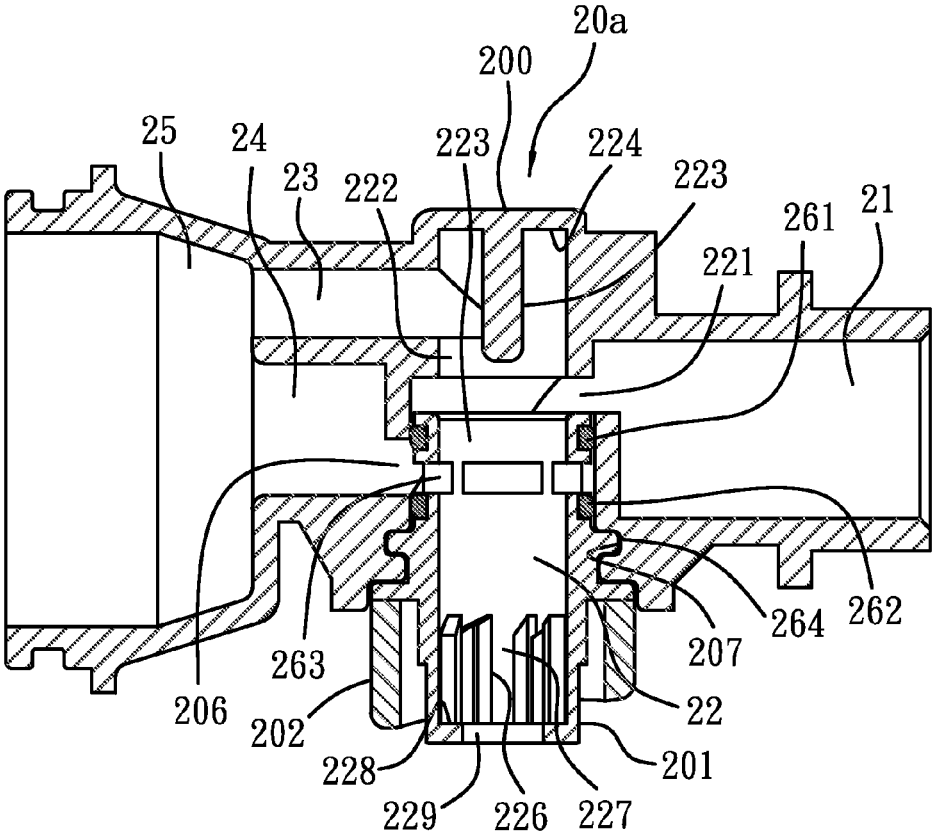
FIG. 5 is a cross sectional view showing a valve holder of the handheld water discharging device according to the preferred embodiment of the present invention.

Referring to FIGS. 1-3, a handheld water discharging device according to a preferred embodiment of the present invention comprises a housing 10, a water supplying pipe 20, a valve core 30, a resilient element 40, a positioning member 50, and a button element 60.

The housing 10 is formed in a tube shape and includes a chamber 11, an inlet end 12, an outlet end 13, and a through hole 14 disposed on a bottom end thereof.

The water supplying pipe 20 is fixed in the chamber 11 of the housing 10 and connected with a hose of a faucet and includes a valve holder 20*a* and a discharge assembly 20*b*, wherein the valve holder 20*a* as shown in FIGS. 4-7 includes an inlet room 21, a distributing room 22, a peripheral flowing room 23, a central flowing room 24, and a groove 25.

The inlet room 21 is used to receive water from the hose of the faucet. In this embodiment, the valve holder 20*a* includes a connector portion 211 mounted on an outer wall of the inlet room 21 to coupled with the hose.

The distributing room 22 includes an inlet 221 fixed on a first inflow side thereof to communicate with the inlet room 21 and includes a first exit 222 formed above the inlet 221 and a second exit 223 arranged below the inlet 221, wherein the distributing room 22 also includes a fixing pillar 224 secured on a top end thereof and a locating fringe 225 disposed on an inner wall of the fixing pillar 224.

Figure 8:
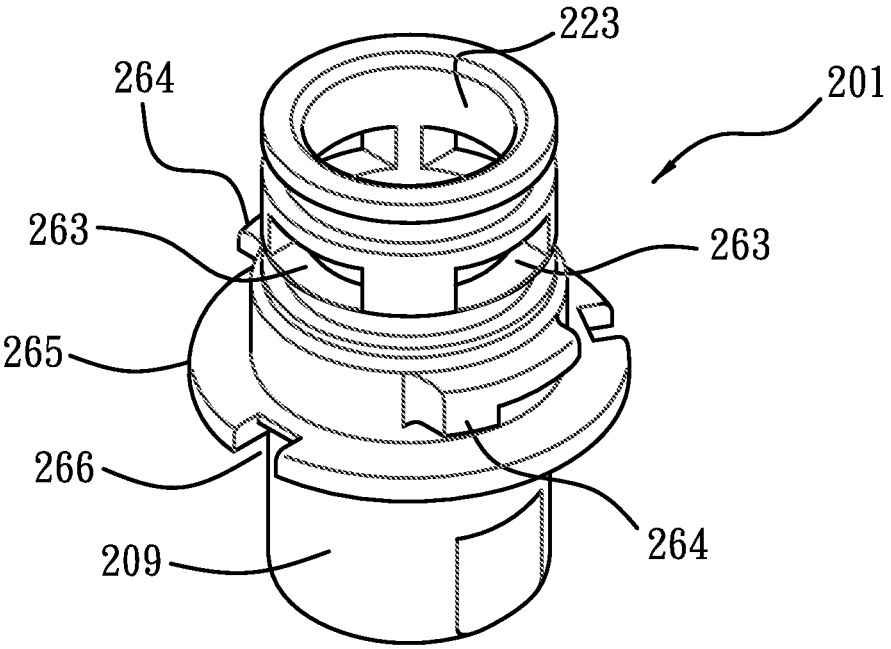
FIG. 8 is a perspective view showing the assembly of a bottom base of the valve holder of the handheld water discharging device according to the preferred embodiment of the present invention.
Figure 9:
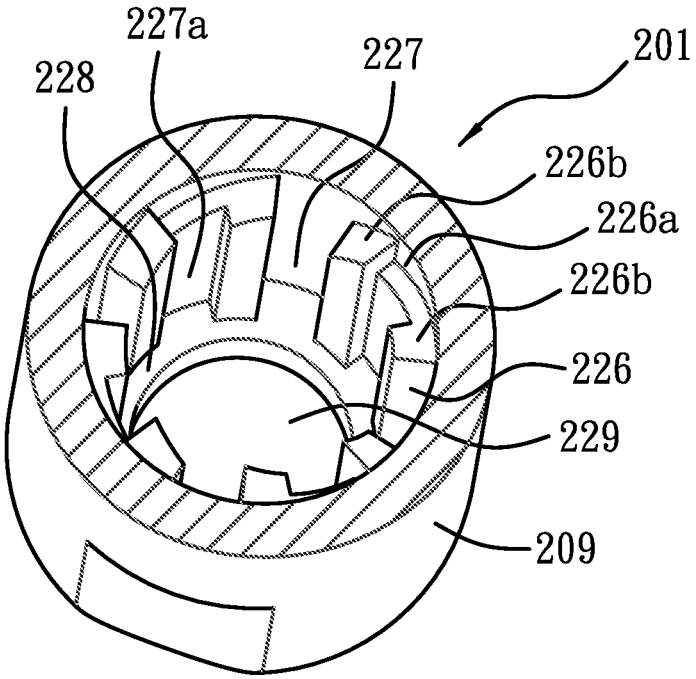
FIG. 9 is a perspective view showing the cross-sectional assembly of the bottom base of the valve holder of the handheld water discharging device according to the preferred embodiment of the present invention.

The distributing room 22 includes a plurality of ratchet blocks 226 mounted around an inner wall thereof. In this embodiment, there are four ratchet blocks 226 arranged around the inner wall of the distributing room 22 and spaced apart equally as illustrated in FIGS. 8 and 9, and each ratchet block 226 includes a recess portion 226*a* fixed on the top end thereof and two top planes 226*b* on two sides of the recess portion 226*a* individually, between each two abutting ratchet blocks 226 is defined an axial slot 227, i.e., there are four axial slots 227 provided and spaced apart equally in this embodiment.

The ratchet block 226 includes a first axial recess 227*a* formed on an inner wall thereof, and a radial depth thereof is less that that of the axial slot 227.

The distributing room 22 further includes a bottom surface 228 formed on a bottom end thereof and an aperture 229 disposed on a central portion of the bottom surface 228 thereof.

The peripheral flowing room 23 is located at a first outflow side of an upper end of the distributing room 22 to communicate with the first exit 222.

The central flowing room 24 is located at a second outflow side of a central portion of the distributing room 22 to communicate with the second exit 223.

The groove 25 is located between the first and the second outflow sides of the peripheral flowing room 23 and the central flowing room 24 to communicate with the peripheral flowing room 23 and the central flowing room 24.

The valve holder 20*a* is comprised of a body 200, a bottom base 201, and a fitting member 202.

The body 200 is a main component of the valve holder 20*a* and includes one parts of the inlet room 21 and the distributing room 22, the peripheral flowing room 23, the central flowing room 24, the groove 25, the inlet 221, the first exit 222, and the fixing pillar 224, wherein the body 200 includes a receiving space 203 arranged on a lower portion of the distributing room 22, and the receiving space 203 includes an upper opening 204, a lower opening 205, and a connecting opening 206 defined between the upper and the lower openings 204, 205 to communicate with the central flowing room 24, and the lower opening 205 includes two retaining notches 207 symmetrically secured around a lower side thereof.

The bottom base 201 is formed in a cylinder shape and fixed in the receiving space 203 of the body 200 and includes a bottom fence 208 and a peripheral fence 209 extending upward from the bottom fence 208; between the bottom fence 208 and the peripheral fence 209 is defined an area to use as another part of the distributing room 22 so that the distributing room 22 is comprised of the area between the bottom fence 208 and the peripheral fence 209 and the one part of the distributing room 22 to use as the body 200.

The peripheral fence 209 includes a first sealing pad 261 retained on an outer wall of an upper side thereof to engage with an inner wall of the upper opening 204 and includes a second sealing pad 262 retained on an outer wall of a lower side of the first sealing pad 261 to engage with an inner wall of the lower opening 205 thereof.

The bottom base 201 also includes a number of annular bores 263 arranged on the peripheral fence 209 to communicate with the connecting opening 206 of the body 200, and the second exit 223 is defined on an inner wall of the bottom base 201 above the bores 263, the bottom base 201 further includes the ratchet blocks 226 formed on the inner wall thereof below the bores 263, the axial slots 227, the first axial recesses 227*a*, and the bottom surface 228 and the aperture 229 on the bottom fence 208.

The peripheral fence 209 including two engaging projections 264 symmetrically disposed on an outer wall below the second sealing pad 262 to rotably engage with the retaining notches 207 of the body 200 so that the bottom base 201 is fixed in the body 200.

The bottom base 201 includes a locking rim 265 radically extending from an outer wall thereof below the engaging projections 264, and the locking rim 265 includes two gaps 266 symmetrically mounted thereon.

The fitting member 202 is formed in a ring shape and includes two elastic hooks 267 symmetrically extending from a top wall thereof to retain with the locking rim 265 through the gaps 266 so that the fitting member 202 is fixed on the bottom base 201, and an outer wall of the fitting member 202 corresponds to an inner wall of the through hole 14 of the housing 10.

The discharge assembly 20*b* is located at a third outflow side of the valve holder 20*a* and includes a disk member 27, a central coupling member 28, a first outflow member 270, and a second outflow member 280.

The disk member 27 screws with the outlet end 13 of the housing 10 and includes a trench 271 fixed on a central portion thereof.

The central coupling member 28 includes two ends to connect with the second outflow side of the central flowing room 24 and a second inflow side of the disk member 27 respectively and includes an orifice 281 formed on a central portion thereof to flow water from the central flowing room 24 into the trench 271.

The disk member 27 includes an outflow cavity 272 defined between the central coupling member 28 and an inner wall of the groove 25 to communicate with the peripheral flowing room 23.

The first outflow member 270 is integrally molded on a peripheral side of the disk member 27 so that the water from the outflow cavity 272 flows through the first outflow member 270 to form a first functional water spray. In this embodiment, the first outflow member 270 includes a plurality of nozzles 273 to spray water in a water spray type.

The second outflow member 280 screws in the trench 271 of the disk member 27 so that the water from the orifice 281 flows through the second outflow member 280 to form a second functional water spray. In this embodiment, the second outflow member 280 is a wave generator to spray water in a water bubble type.

Figure 6:
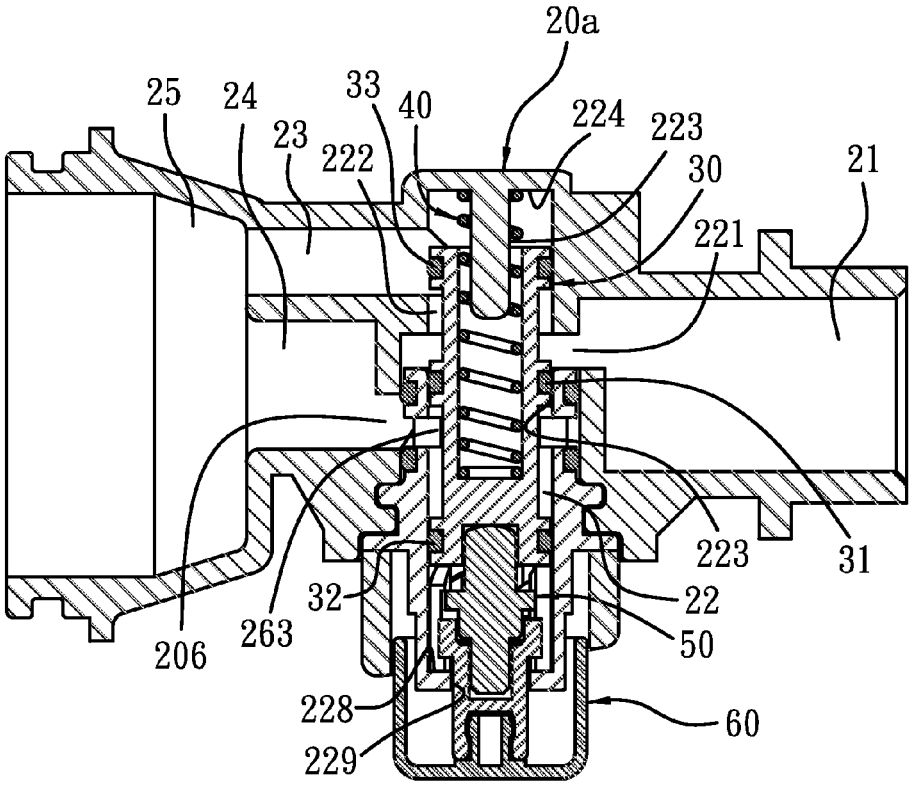
FIG. 6 is a cross sectional view showing the assembly of the valve holder of the handheld water discharging device according to the preferred embodiment of the present invention.
Figure 7:
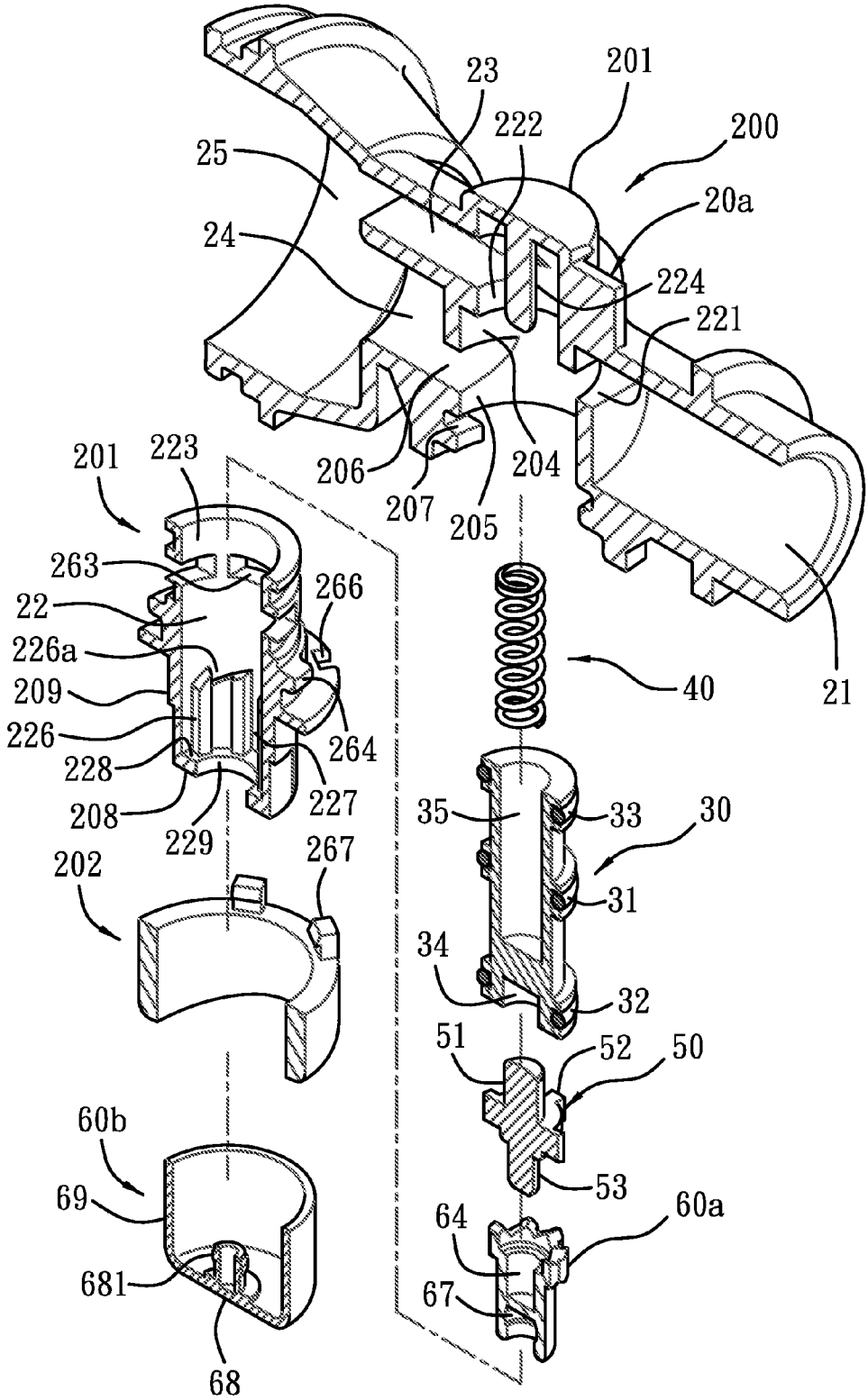
FIG. 7 is a perspective view showing the cross-sectional assembly of the valve holder of the handheld water discharging device according to the preferred embodiment of the present invention.
Figure 13:
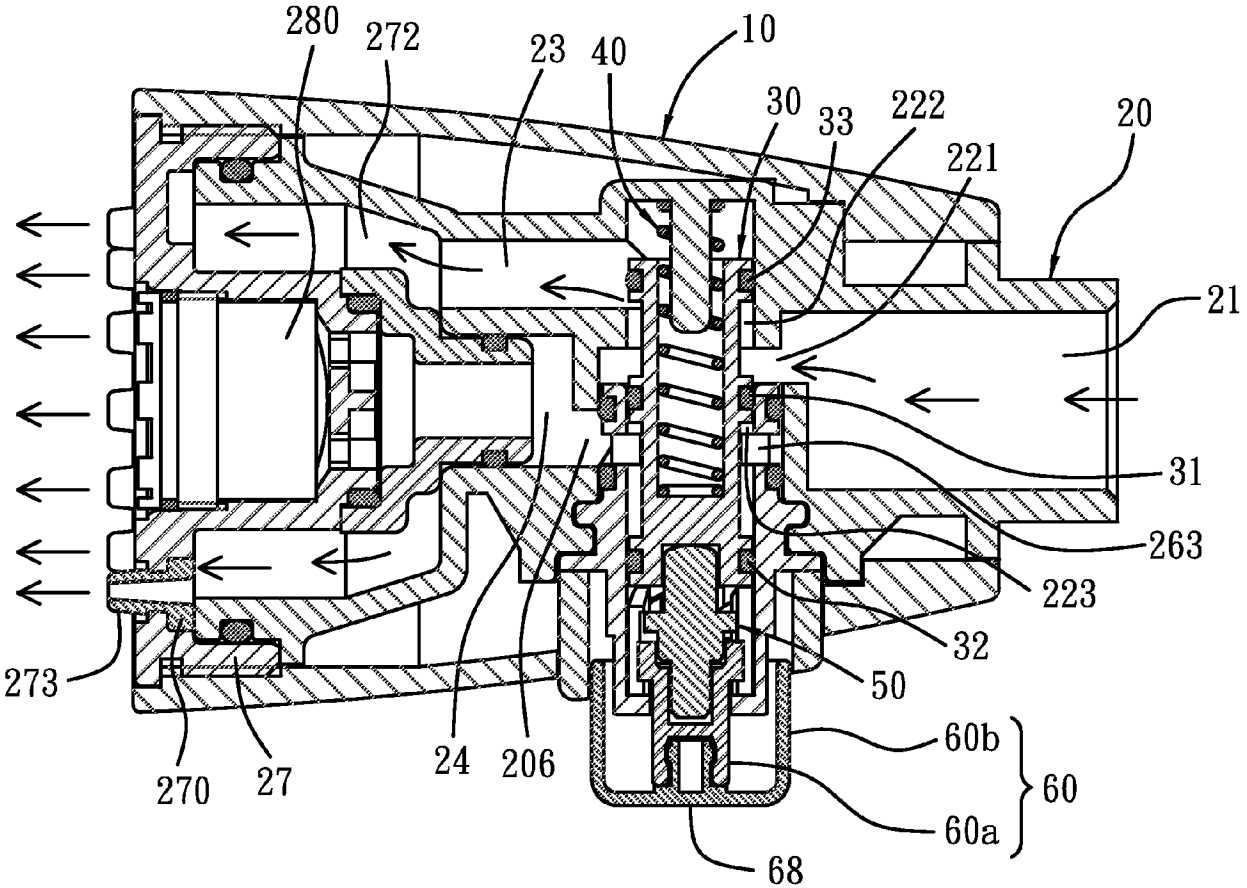
FIG. 13 is a cross sectional view showing the operation of the handheld water discharging device according to the preferred embodiment of the present invention.
Figure 17:
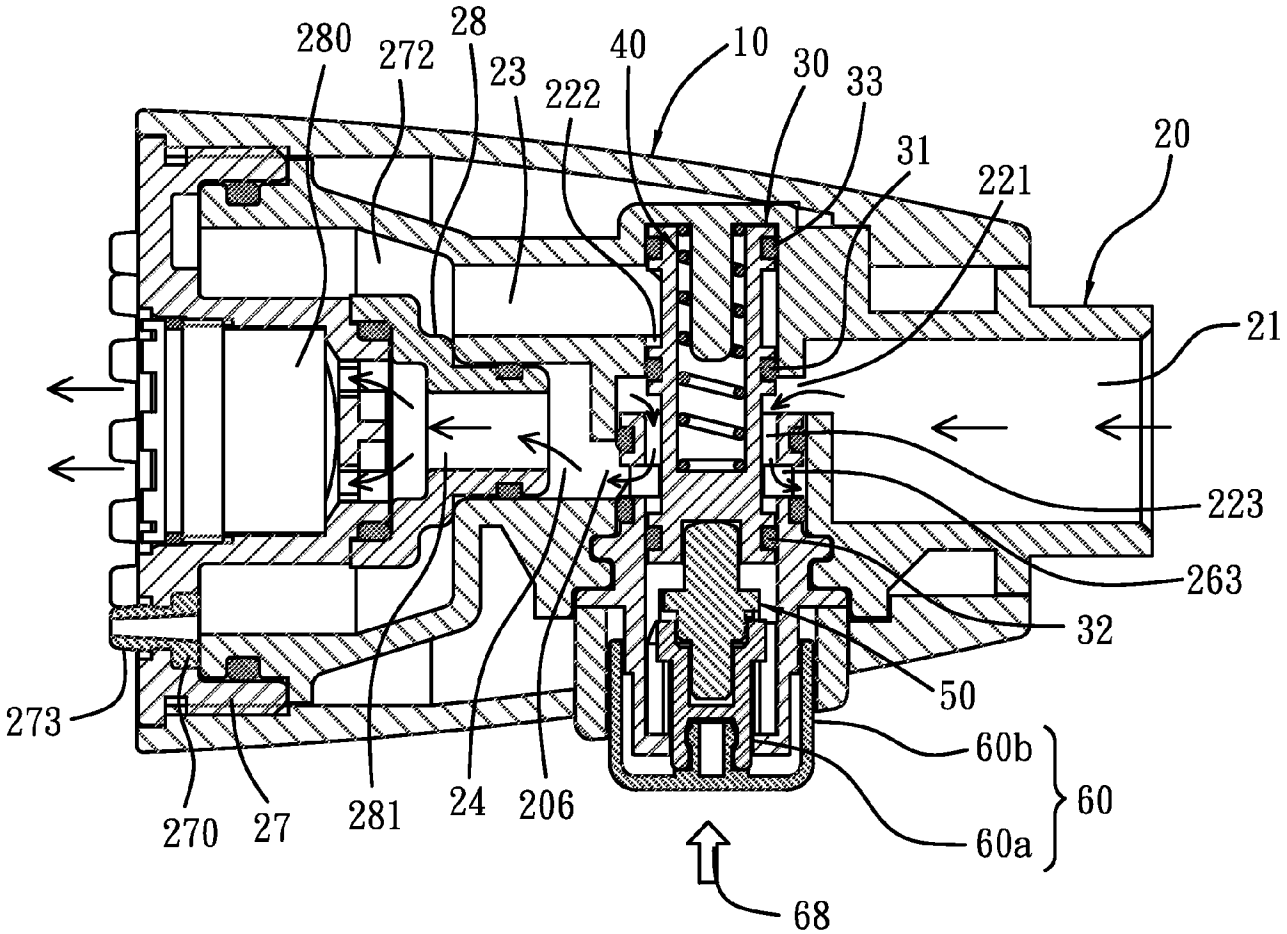
FIG. 17 is another cross sectional view showing the operation of the handheld water discharging device according to the preferred embodiment of the present invention.

The valve core 30, as illustrated in FIGS. 6 and 7, is fixed in the distributing room 22 of the valve holder 20*a*, displaces straightly along the inner wall of the distributing room 22, and includes a first closing segment 31 (e.g., a first closing pad) disposed on a suitable position thereof so that when the valve core 30 is pushed downward to move, the second exit 223 of the valve holder 20*a* is closed by the first closing segment 31, and the first exit 222 is open as shown in FIG. 13. Substantially, the first closing pad 31 slides into the second exit 223 to engage with an inner wall of the second exit 223, and when the valve core 30 is pushed upward to move, the first exit 222 of the valve holder 20*a* is closed by the first closing segment 31, and the first exit 222 is open as illustrated in FIG. 17. Substantially, the first closing pad 31 slides into the first exit 222 to engage with an inner wall of the first exit 222.

The valve core 30 includes a second closing segment 32 (e.g., a second closing pad) mounted on an outer wall thereof below the first closing segment 31 to displace vertically with the valve core 30 so as to movably engage with the peripheral fence 209 below the bores 263 as shown in FIGS. 13 and 17 so that the water flowing through the second exit 223 does not flow into the bottom end of the distributing room 22. In other words, the water flowing through the second exit 223 does not flow into the bottom end of the distributing room 22 to contact with the ratchet blocks 226.

The valve core 30 includes a third closing segment 33 (e.g., a third closing pad) disposed on the outer wall thereof above the first closing segment 31 to displace vertically with the valve core 30 to movably retain with the inner wall of the distributing room 22 above the first exit 221 as shown in FIGS. 13 and 17 so that the valve core 30 displaces in the distributing room 22 stably. Therefore, the third cloning segment 33 is not used to close related components and is not an essential component of the present invention that is capable of being removed from the handheld water discharging device. Also, a top end of the valve core 30 is removed from the handheld water discharging device.

The valve core 30 further includes an abutted section 34 formed in a recess shape and fixed on a bottom end thereof to provide an upward pushing force.

The valve core 30 includes a defining channel 35 formed on a center of the top end thereof.

The resilient element 40, as illustrated in FIGS. 6 and 7, is a compression spring in this embodiment and is fitted on the fixing pillar 224 of the valve holder 20*a*, the resilient element 40 includes a top end to contact with the locating fringe 225 and includes a bottom end retained in the defining channel 35, such that the valve core 30 is pushed downward so that the first closing segment 31 engages with the second exit 223 of the distributing room 22 as illustrated in FIG. 13.

The positioning member 50, as shown in FIGS. 10-13, includes a biasing portion 51 formed in a rod shape and secured on a top end thereof to retain with the abutted section 34 of the valve core 30 so as to push the valve core 30 upward.

The positioning member 50 includes a number of engagement teeth 52 arranged on a middle portion of an outer wall thereof. In this embodiment, there are four engagement teeth 52 provided and spaced apart equally, each engagement tooth 52 moves vertically along the axial slot 227 and includes an inclined face 521 formed on a bottom end thereof.

Figure 15:
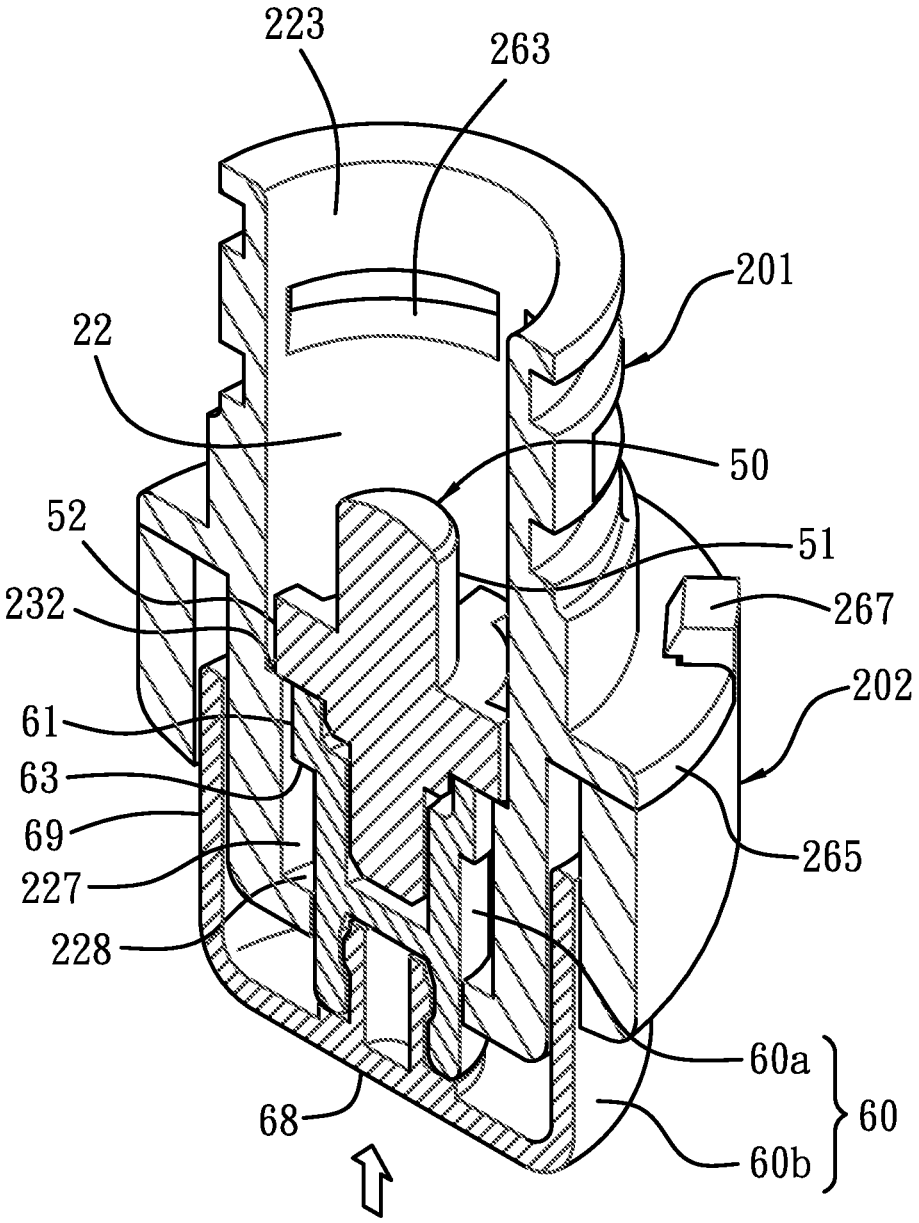
FIG. 15 is a cross-sectional perspective view showing the operation of the handheld water discharging device according to the preferred embodiment of the present invention.
Figure 16:
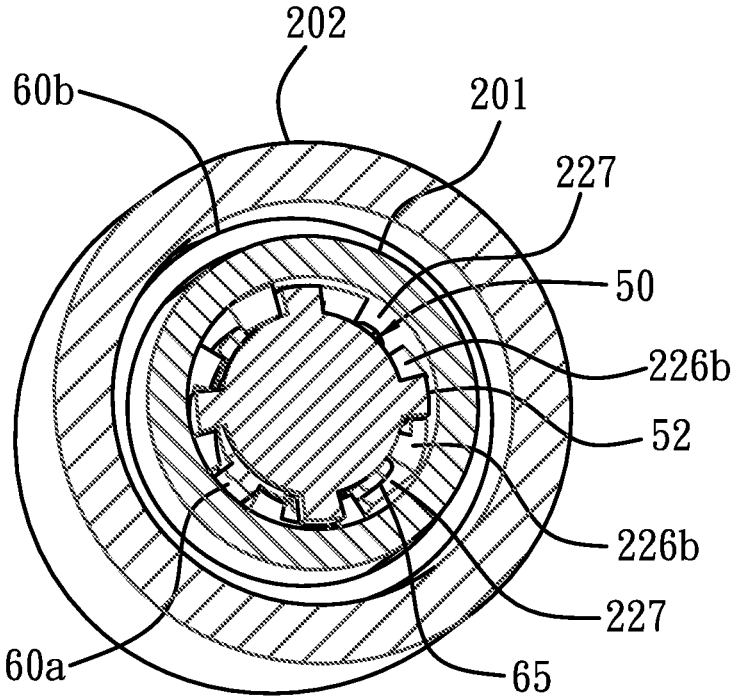
FIG. 16 is a cross-sectional perspective view showing the operation of the positioning member of the handheld water discharging device according to the preferred embodiment of the present invention.

The engagement teeth 52 are pushed upward to disengage from the axial slots 227 so that the resilient element 40 recovers its resilience, and the valve core 30 forces the positioning member 50, hence the engagement teeth 52 are forced to rotably slide into the recess portions 226*a* individually to position. As illustrated in FIGS. 15 and 16, during a rotating process, the inclined faces 521 of the engagement teeth 52 contact with the recess portions 226*a* to move.

When the engagement teeth 52 engage with the recess portions 226*a*, due to the positioning member 50 is positioned at a first upper position, the valve core 30 is biased against by the positioning member 50 so that the first closing segment 321 keeps closing the first exit 222 as illustrated in FIG. 17.

When the engagement teeth 52 are pushed upward again to disengage from the recess portions 226*a*, they are forced by the resilient element 40 to rotate toward a circumferential direction and to further disengage from the ratchet blocks 226 so as to move above the axial slots 227, and when an upward pushing force disappears, the engagement teeth 52 are forced by the resilient element 40 indirectly to move downward along the axial slots 227 so that the first closing segment 31 of the valve core 30 keeps closing the second exit 223 as shown in FIG. 13.

The positioning member 50 further includes a stem 53 extending from a bottom end thereof.

Figure 14:
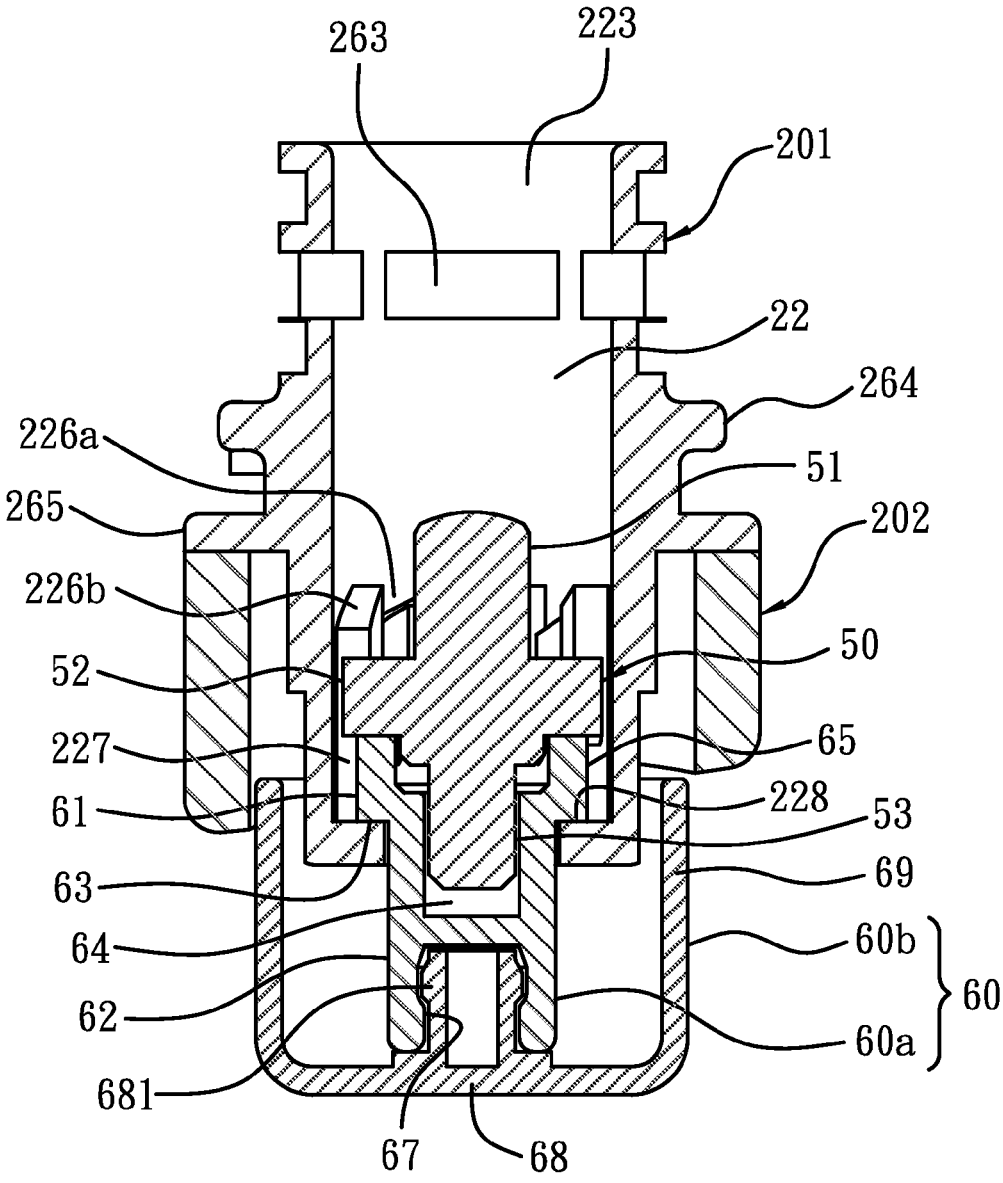
FIG. 14 is a cross sectional view showing the assembly of the bottom base, a fitting member, the positioning member, and a button element of the handheld water discharging device according to the preferred embodiment of the present invention.

The button element 60, as illustrated in FIGS. 7 and 14, is comprised of an actuated protrusion 60*a* and a sleeve 60*b*, wherein the actuated protrusion 60*a* is formed in a stepped rod shape and includes a loop 61 disposed on a top end thereof, an extension 62 mounted on a bottom end of the loop 61, a stepped periphery 63 located between the loop 61 and the extension 62; the loop 61 is limited on the bottom end of the distributing room 22 of the valve holder 20*a* and includes a pore 64 mounted on a center of a top end thereof to receive the stem 53 of the positioning member 50 and includes a plurality of sliding tabs 65 arranged around an outer wall of an upper side thereof to move along the axial slots 227 and the axial recesses 227*a*.

Figure 12:
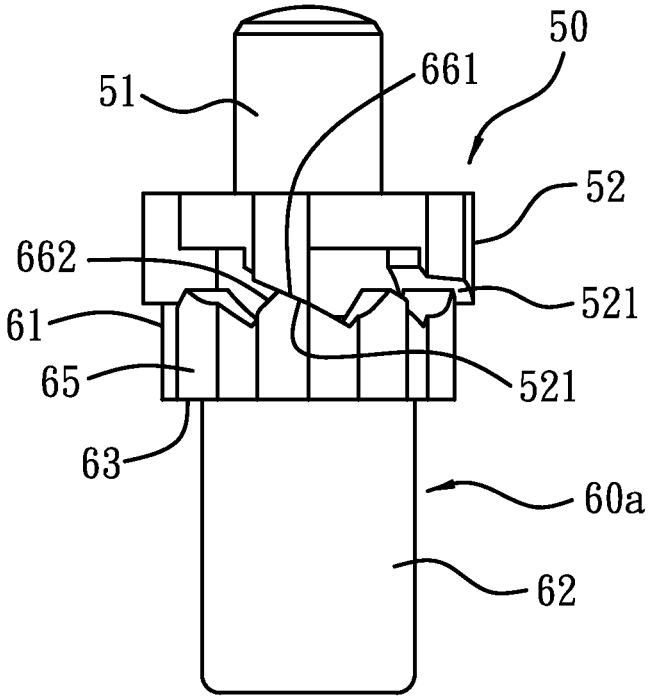
FIG. 12 is a side plan view showing the operation of the positioning member and the actuated protrusion of the handheld water discharging device according to the preferred embodiment of the present invention.

The actuated protrusion 60*a* includes a number of conical sections 66 formed on a top end thereof, and each conical section 66 includes a first tilted plane 661 and a second tilted plane 662, the first tilted plane 661 engages with the inclined face 521 of the engagement tooth 52 as shown in FIGS. 12 and 13.

The extension 62 of the actuated protrusion 60*a* extends downward from the aperture 229 of the distributing room 22, wherein when the actuated protrusion 60*a* is pushed downward to move, the stepped periphery 63 of the actuated protrusion 60*a* engages with the bottom surface 228 as illustrated in FIG. 14 so that the actuated protrusion 60*a* is axially limited.

The extension 62 of the actuated protrusion 60 includes a trough 67 secured on a central portion of a bottom end thereof.

The sleeve 60*b* is formed in a cover shape and includes a pressing segment 68 and a peripheral side segment 69, and the pressing segment 68 includes an elastic column 681 extending from an inner wall thereof to retain with the trough 67, wherein an outer wall of the pressing segment 68 is pressed by a user to push the actuated protrusion 60*a* to move upward, and the peripheral side segment 69 is received between an inner wall of the fitting member 202 and the outer wall of the bottom base 201.

Figure 10:
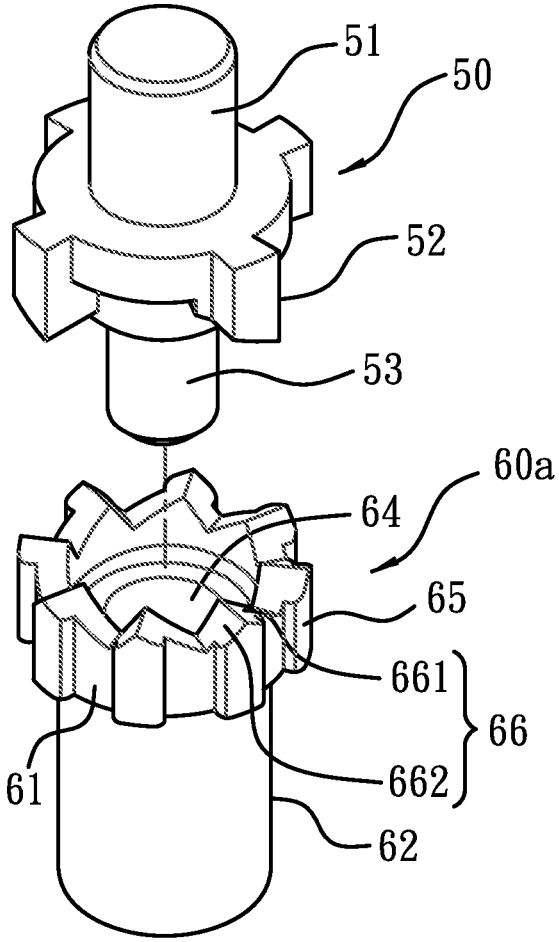
FIG. 10 is a perspective view showing the assembly of a positioning member and an actuated protrusion of the handheld water discharging device according to the preferred embodiment of the present invention.
Figure 11:
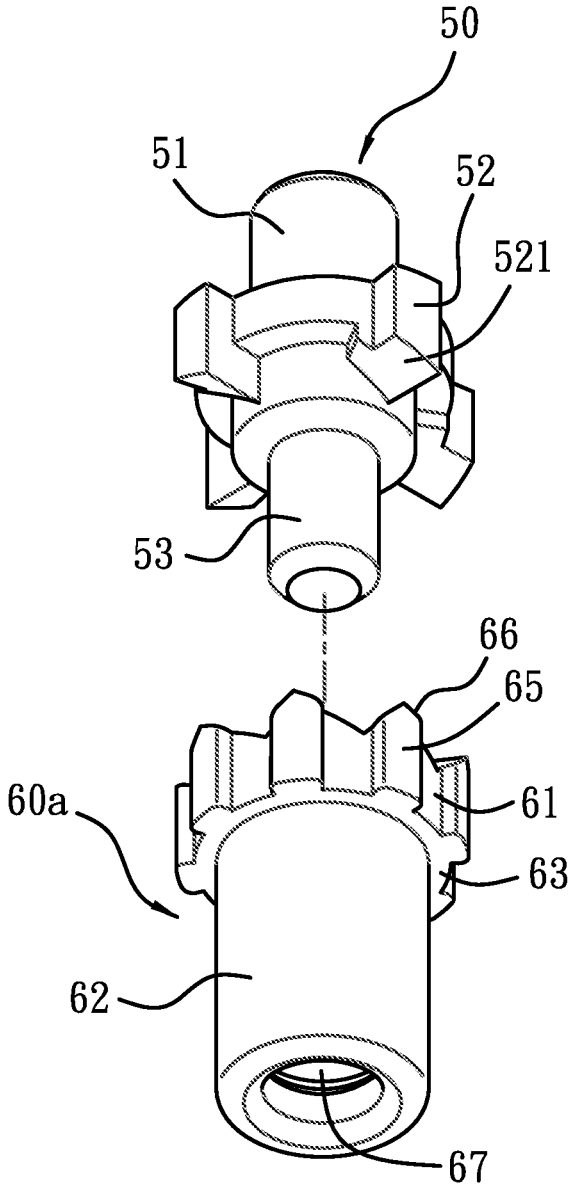
FIG. 11 is another perspective view showing the assembly of the positioning member and the actuated protrusion of the handheld water discharging device according to the preferred embodiment of the present invention.

While the pressing segment 68 of the sleeve 60*b* is pressed upward, the actuated protrusion 60*a* is actuated so that the button element 60 is pushed upward. In the meantime, the first tilted plane 661 of the actuated protrusion 60*a* pushes the inclined face 521 of the engagement tooth 52 as illustrated in FIGS. 10 and 13 so that the positioning member 50 is pushed upward to further push the valve core 30.

It is preferable that the first tilted plane 661 and the inclined face 521 are formed at a same oblique angle so that they contacts with each other, the first tilted plane 661 pushes the inclined face 521, and the engagement tooth 52 moves into the recess portion 226*a* smoothly.

When the sleeve 60*b* of the handheld water discharging device is not pressed, the water from the inlet room 21 of the water supplying pipe 20 flows into the distributing room 22 via the inlet 221 of the valve holder 20*a*, and the valve core 30 is biased against by the resilient element 40 to move downward so as to locate below the distributing room 22, e.g., the first closing segment 31 moves downward to disengage from the inner wall of the first exit 222 to engage and close the inner wall of the second exit 22 so that the first exit is opened and the second exit is closed, hence the water in the distributing room 22 is guided to flow to the first exit 222 and further flows into the outflow cavity 272 along the peripheral flowing room 23. Thereafter, the water flows out of the first outflow member 270 of the disk member 27 to form the first functional water spray as shown in FIG. 13. In this embodiment, the first outflow member 270 is used to spray water in the water spray type.

The user is capable of switching different water spray levels by pressing the pressing segment 68 of the sleeve 60*b* of the button element 60 so that the actuated protrusion 60*a* is actuated to actuate the positioning member 50 and the valve core 30 to move toward a second upper position, thereby the second exit 223 is opened, and the first exit 222 is closed by the first closing segment 31 of the valve core 30 so that the water in the distributing room 22 flows into the central flowing room 24 via the second exit 223, the bores 263, and the connecting opening 206 and further flows to the second outflow member 280 along the central flowing room 24 and the orifice 281 of the central coupling member 28 so as to form the second functional water spray as illustrated in FIG. 17. In this embodiment, the second outflow member 280 is applied to spray water in the water bubble type.

As above-mentioned description, when the sleeve 60*b* is pressed to push the valve core 30 to move above the distributing room 22 so as to generate the second functional water spray type, the engagement teeth 52 of the positioning member 50 do not disengage from the axial slots 227, and the inclined faces 521 of the engagement teeth 52 automatically rotate toward the recess portions 226*a*, accordingly when the sleeve 60*b* is released, the inclined faces 521 of the engagement teeth 52 engage with the recess portions 226*a* as illustrated in FIGS. 15 and 16 so that the positioning member 50 is retained at a higher position, and the valve core 30 is abutted against by the positioning member 50, hence a level of the first functional water spray is kept without being pressed constantly and being affected by a low water pressure, thus operating the handheld water discharging device easily.

Figure 18:
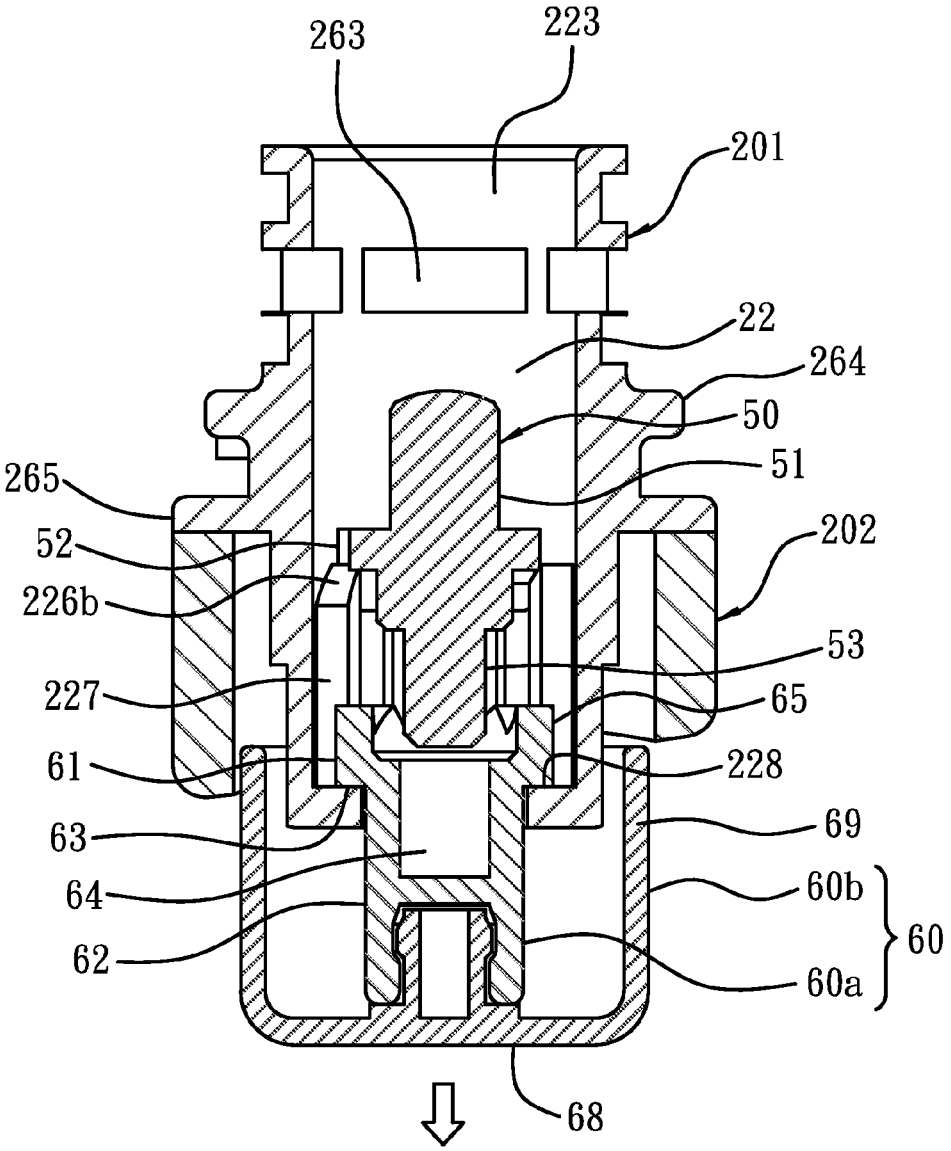
FIG. 18 is another cross sectional view showing the operation of the handheld water discharging device according to the preferred embodiment of the present invention.

While the positioning member 50 is retained to be kept at a higher position and the sleeve 60*b* is released, the button element 60 is not pushed by the resilient element 40, therefore the button element 60 moves downward to a normal position as illustrated in FIG. 18, however it does not influence any switch of different functional water spray levels.

As above-mentioned description, the sleeve 60*b* is pressed once more so that the engagement teeth 52 of the positioning member 50 disengage from the ratchet blocks 226 so that when the sleeve 60*b* is released, the engagement teeth 52 slide into the axial slots 227 to returns back to a lower position, and the valve core 30 is biased against by the resilient element 40 to return below the distributing room 22 so as to form the first functional water spray. Thereby, different functional water spray levels are switched quickly and easily.

The handheld water discharging device is used in a downward pulled faucet in the kitchen or general showers.

While we have shown and described various embodiments in accordance with the present invention, it is clear to those skilled in the art that further embodiments may be made without departing from the scope of the present invention.

What is claimed is:

1. A handheld water discharging device comprising:

a housing;

a water supplying pipe fixed in the housing and including a valve holder and a discharge assembly; wherein the valve holder includes an inlet room to receive water, a distributing room communicating with the inlet room, a peripheral flowing room communicating with the distributing room through a first exit, a central flowing room communicating with the distributing room through a second exit, and a groove communicating with the peripheral flowing room and the central flowing room;

the distributing room includes a plurality of ratchet blocks relative to the second exit;

the discharge assembly is fixed at the groove of the valve holder and includes a first outflow member to flow water from the peripheral flowing room so as to form a first functional water spray, and a second outflow member to flow water from the central flowing room so as to form a second functional water spray;

a valve core displaces in the distributing room and includes a first closing segment to close the first exit so that the second exit is open and closes the second exit of the valve holder such that that the first exit is open;

a resilient element is used to push the valve core downward;

a positioning member is fixed in the distributing room and is pushed upward and rotated properly to retain with the plurality of ratchet blocks and to push the valve core so that the first closing segment keeps closing the first exit, and the positioning member rotates to disengage from the ratchet blocks when being pushed upward again and then the resilient element pushes the valve core downward so that the positioning member is pushed downwardly by ways of the valve core and is positioned, and the first closing segment of the valve core keeps closing the second exit;

a button element serves as to push the positioning member upward properly;

wherein the housing is formed in a tube shape and includes an inlet end, an outlet end, and a through hole disposed on a bottom end thereof;

the distributing room includes an inlet fixed on a first inflow side thereof to communicate with the inlet room and includes the first exit formed above the inlet, the second exit arranged below the inlet, and the ratchet blocks mounted around an inner wall thereof, each ratchet block includes a recess portion fixed on a top end thereof and two top planes on two sides of the recess portion individually, between each two abutting ratchet blocks is defined an axial slot;

the first closing segment of the valve core closes the first exit of the valve holder when the valve core is pushed upward to move so that the second exit is open; and when the valve core is pushed downward to move, the second exit of the valve holder is closed by the first closing segment so that the first exit is open;

the valve core includes a second closing segment mounted below the first closing segment to displace vertically with the valve core so as to movably engage with the inner wall of the distributing room above the ratchet blocks;

the resilient element is fitted between a top end of the valve core and a top end of the distributing room;

the positioning member includes a number of engagement teeth arranged on an outer wall thereof, and each engagement tooth moves vertically along the axial slot and includes an inclined face formed on a bottom end thereof so that when the positioning member is pushed upward, the engagement teeth disengage from the axial slots to rotate toward a circumferential direction and to retain in the recess portions; and when the positioning member is pushed upward, the engagement teeth disengage from the recess portions to rotate toward the circumferential direction and to locate above the axial slots, and when an upward pushing force disappears, the engagement teeth move into the axial slots so that the valve core is pushed downward to move;

the button element inserts through a bottom end of the distributing room and includes a loop, the loop includes a plurality of sliding tabs arranged around an outer wall to move along the axial slots and a number of first tilted planes disposed on a top end thereof;

the loop includes an extension mounted on a bottom end thereof and extending downward out of the bottom end of the distributing room and pushed upward so that the first tilted planes engage with the inclined faces of the engagement teeth;

wherein the valve holder is comprised of a body, a bottom base, and a fitting member;

the body is a main component of the valve holder and includes one part of the inlet room and the distributing room, the peripheral flowing room, the central flowing room, the groove, the inlet, and the first exit, wherein the body includes a receiving space arranged on a lower portion of the distributing room, and the receiving space includes an upper opening, a lower opening, and a connecting opening defined between the upper and the lower openings to communicate with the central flowing room;

the bottom base is fixed in the receiving space of the body and includes a bottom fence and a peripheral fence extending upward from the bottom fence;

between the bottom fence and the peripheral fence is defined an area to use as another part of the distributing room so that the distributing room is comprised of the area between the bottom fence and the peripheral fence and the one part of the distributing room to use as the body;

the peripheral fence includes a first sealing pad retained on an outer wall of an upper side thereof to engage with an inner wall of the upper opening and includes a second sealing pad retained on an outer wall of a lower side of the first sealing pad to engage with an inner wall of the lower opening thereof;

the bottom base further includes a number of annular bores arranged on the peripheral fence to communicate with the connecting opening of the body, and the second exit is defined on an inner wall of the bottom base above the bores, the bottom base further includes the ratchet blocks and the axial slots formed on the inner wall thereof below the bores;

the fitting member is fixed on the bottom base, and an outer wall of the fitting member corresponds to an inner wall of the through hole of the housing;

wherein the first closing segment of the valve core is a first closing pad and the second closing segment of the valve core is a second closing pad;

the first closing pad slides into the first exit to engage with an inner wall of the first exit to stop water flowing through; and the second closing pad engages with the peripheral fence below the bores so that water flowing through the second exit does not flow into the bottom end of the distributing room to contact with the ratchet blocks.

2. The handheld water discharging device as claimed in claim 1, wherein the lower opening of the body includes two retaining notches symmetrically secured around a lower side thereof; the peripheral fence of the bottom base includes two engaging projections engaged with the retaining notches so that the bottom base is fixed in the body.

3. The handheld water discharging device as claimed in claim 1, wherein the ratchet block of the bottom base includes a first axial recess formed on an inner wall thereof, and a radial depth thereof is less that that of the axial slot so that the engagement teeth of the positioning member move along the first axial recess.

4. The handheld water discharging device as claimed in claim 1, wherein the distributing room includes a fixing pillar secured on a top end thereof and a locating fringe disposed on an inner wall of the fixing pillar; the valve core includes a defining channel formed on the top end thereof; the resilient element is a compression spring fitted on the fixing pillar and includes a top end to contact with the locating fringe and a bottom end retained in the defining channel.

5. The handheld water discharging device as claimed in claim 1, wherein the valve core further includes an abutted section fixed on a bottom end thereof; the positioning member includes a biasing portion secured on a top end thereof to retain with the abutted section.

6. The handheld water discharging device as claimed in claim 5, wherein the abutted section is formed in a recess shape, and the biasing portion is formed in a rod shape.

7. The handheld water discharging device as claimed in claim 1, wherein the valve core includes a third closing segment disposed on an outer wall thereof above the first closing segment to displace vertically with the valve core and to movably retain with the inner wall of the distributing room above the first exit.

8. The handheld water discharging device as claimed in claim 7, wherein the third closing segment is a third closing pad.

9. The handheld water discharging device as claimed in claim 1, wherein the button element is comprised of an actuated protrusion and a sleeve; the actuated protrusion includes a loop disposed on a top end thereof and an extension mounted on a bottom end of the loop; the sleeve is movably connected on the extension of the actuated protrusion and includes a pressing segment to be forced by a user.

10. The handheld water discharging device as claimed in claim 9, wherein the actuated protrusion includes a stepped periphery located between the loop and the extension, the distributing room further includes a bottom surface formed on the bottom end thereof and an aperture disposed on a central portion of the bottom surface thereof to receive the extension of the actuated protrusion, and the stepped periphery of the actuated protrusion engages with the bottom surface so that the actuated protrusion is axially limited.

11. The handheld water discharging device as claimed in claim 9, wherein the positioning member further includes a stem extending from a bottom end thereof; the actuated member includes a pore mounted on the top end thereof to receive the stem of the positioning member.

12. The handheld water discharging device as claimed in claim 9, wherein the extension of the actuated protrusion includes a trough secured on a bottom end thereof; the sleeve is formed in a cover shape and includes the pressing segment and a peripheral side segment, and the pressing segment includes an elastic column extending from an inner wall thereof to retain with the trough, and an outer wall of the pressing segment is pressed by a user.

13. The handheld water discharging device as claimed in claim 9, wherein the actuated protrusion includes a number of conical sections formed on the top end thereof, and each conical section includes a first tilted plane and a second tilted plane.

14. The handheld water discharging device as claimed in claim 9, wherein the first tilted plane and the inclined face are formed at a same oblique angle so that they contact with each other.

15. The handheld water discharging device as claimed in claim 1, wherein the discharge assembly further includes a disk member and a central coupling member; the disk member screws with the outlet end of the housing and includes a trench fixed on a central portion thereof; the central coupling member includes two ends to connect with a second outflow side of the central flowing room and a second inflow side of the disk member respectively and includes an orifice formed on a central portion thereof to flow the water from the central flowing room into the trench, the second outflow member screws in the trench of the disk member; the disk member includes an outflow cavity defined between the central coupling member and an inner wall of the groove to communicate with the peripheral flowing room, and the first outflow member is integrally molded on a peripheral side of the disk member.

16. The handheld water discharging device as claimed in claim 15, wherein the first outflow member includes a plurality of nozzles to spray water in a water spray type.

17. The handheld water discharging device as claimed in claim 15, wherein the second outflow member is a wave generator to spray water in a water bubble type.

18. A handheld water discharging device comprising:

a housing;

a water supplying pipe fixed in the housing and including a valve holder and a discharge assembly; wherein the valve holder includes an inlet room to receive water, a distributing room communicating with the inlet room, a peripheral flowing room communicating with the distributing room through a first exit, a central flowing room communicating with the distributing room through a second exit, and a groove communicating with the peripheral flowing room and the central flowing room;

the distributing room includes a plurality of ratchet blocks relative to the second exit;

the discharge assembly is fixed at the groove of the valve holder and includes a first outflow member to flow water from the peripheral flowing room so as to form a first functional water spray, and a second outflow member to flow water from the central flowing room so as to form a second functional water spray;

a valve core displaces in the distributing room and includes a first closing segment to close the first exit so that the second exit is open and closes the second exit of the valve holder such that that the first exit is open;

a resilient element is used to push the valve core downward;

a positioning member is fixed in the distributing room and is pushed upward and rotated properly to retain with the plurality of ratchet blocks and to push the valve core so that the first closing segment keeps closing the first exit, and the positioning member rotates to disengage from the ratchet blocks when being pushed upward again so that the resilient element pushes the valve core downward, and then the positioning member is pushed downwardly by ways of the valve core and is positioned, and the first closing segment of the valve core keeps closing the second exit;

a button element serves as to push the positioning member upward properly;

wherein the housing is formed in a tube shape and includes an inlet end, an outlet end, and a through hole disposed on a bottom end thereof;

the distributing room includes an inlet fixed on a first inflow side thereof to communicate with the inlet room and includes the first exit formed above the inlet, the second exit arranged below the inlet, and the ratchet blocks mounted around an inner wall thereof, each ratchet block includes a recess portion fixed on a top end thereof and two top planes on two sides of the recess portion individually, between each two abutting ratchet blocks is defined an axial slot;

the first closing segment of the valve core closes the first exit of the valve holder when the valve core is pushed upward to move so that the second exit is open; and when the valve core is pushed downward to move, the second exit of the valve holder is closed by the first closing segment so that the first exit is open;

the resilient element is fitted between a top end of the valve core and a top end of the distributing room;

the positioning member includes a number of engagement teeth arranged on an outer wall thereof, and each engagement tooth moves vertically along the axial slot and includes an inclined face formed on a bottom end thereof so that when the positioning member is pushed upward, the engagement teeth disengage from the axial slots to rotate toward a circumferential direction and to retain in the recess portions; and when the positioning member is pushed upward, the engagement teeth disengage from the recess portions to rotate toward the circumferential direction and to locate above the axial slots, and when an upward pushing force disappears, the engagement teeth move into the axial slots so that the valve core is pushed downward to move;

the button element inserts through a bottom end of the distributing room and includes a loop, the loop includes a plurality of sliding tabs arranged around an outer wall to move along the axial slots and a number of first tilted planes disposed on a top end thereof;

the loop includes an extension mounted on a bottom end thereof and extending downward out of the bottom end of the distributing room and pushed upward so that the first tilted planes engage with the inclined faces of the engagement teeth;

wherein the first closing segment of the valve core is a first closing pad and slides into the first exit or the second exit of the valve core to engage with an inner wall of the first exit or the second exit to stop water flowing through.

* * * * *